United States Patent [19]

Johnson

[11] 3,996,992

[45] Dec. 14, 1976

[54] METHOD OF VACUUM CASTING MOLTEN METAL

[76] Inventor: Charles W. Johnson, P.O. Box 96, Princeton, Iowa 52768

[22] Filed: Mar. 17, 1975

[21] Appl. No.: 558,704

[52] U.S. Cl. ..... 164/63; 164/128; 164/131

[51] Int. Cl.[2] ..... B22D 27/16; B22D 29/00

[58] Field of Search ..... 164/61, 63, 254, 65, 164/253, 257, 348, 131, 128, 404–408; 264/DIG. 78

[56] References Cited

UNITED STATES PATENTS

| | | | |
|---|---|---|---|
| 1,912,981 | 6/1933 | Hoy | 164/119 X |
| 2,863,188 | 12/1958 | Harrison | 164/257 |
| 2,923,040 | 2/1960 | Goodwin et al. | 164/63 |
| 2,987,788 | 6/1961 | Lyman | 164/348 |

FOREIGN PATENTS OR APPLICATIONS

| | | | |
|---|---|---|---|
| 466,835 | 10/1928 | Germany | 164/254 |
| 25,968 | 7/1972 | Japan | 164/131 |
| 387,234 | 5/1965 | Switzerland | 164/254 |
| 238,735 | 8/1969 | U.S.S.R. | 164/405 |
| 126,995 | 5/1959 | U.S.S.R. | 164/254 |

*Primary Examiner*—Robert D. Baldwin
*Attorney, Agent, or Firm*—Morton S. Adler

[57] ABSTRACT

An elongated movable water cooled mold of any desired cross section has an open bottom end which is lowered into a pot of molten metal a predetermined distance with the metal being pulled into the mold under vacuum operated by suitable controls for establishing the desired length of the casting or billet. Water is supplied to the mold while still in the pot to permit the casting to harden and the mold is then removed therefrom and moved to a position close to floor level where termination of the water supply allows the contained heat in the casting to reheat the mold and expand it sufficiently so that the casting can drop free of the mold upon release of the vacuum.

6 Claims, 6 Drawing Figures

20
18
12
14
10
60
70
62
56
66
72
68
16
50a
94
34
58
96
75
73
50
46
46b
46a
40b
92
52
48
88
40a
84
82
102
86
80
90
74
76
100
98
78
46a
40a
54
22
40
42
106
104
108

METHOD OF VACUUM CASTING MOLTEN METAL

BACKGROUND OF THE INVENTION

This invention relates to improvements in methods of casting molten metal and more particularly to such methods concerned with the utilization of a vacuum means for filling the mold in the casting procedures.

One of the important objects of the present invention is to produce billets from selected alloys which may be further efficiently processed in a rolling mill, through an extrusion press, used for electrodes or otherwise that are of uniform density with only a minor variable in the analysis of the cast product and which are completely free of air pockets or air bubbles that can adversely affect final processing. These objectives are difficult to achieve in known and commonly used hand casting methods where analysis of finished pieces from successive castings have shown variations in the metal content of as much as ± 3% that is attributable to inevitable slight variations in temperature and timing inherent in hand casting methods.

The use of a vacuum means for filling a mold in the casting of metal is not a new concept as seen in U.S. Pat. No. 914,679 (1909) and further utilized in principle in such patents as U.S. Pat. Nos. 2,970,350 (1961) and 3,774,668 (1973) and I have employed the vacuum concept in further providing improvements that enhance the quality of the finished casting.

Accordingly, it is another important object herein to provide a water cooled mold whereby upon extension of one end thereof into a pot of molten metal and the filling of the mold by extracting the air therein under vacuum, the casting is quickly cooled sufficiently to harden by directing water rapidly under pressure through the water jacket on the mold.

Another object is to provide the cooling water with a velocity sufficient to prevent any flash steaming and thus maintain consistency in the cooling effect throughout the entire length of the casting.

A further object is to provide a water cooled, vacuum associated mold as characterized wherein upon removal of the mold from the pot with the water cooling function in operation, cessation of the water flow permits contained heat in the casting to reheat the mold and expand it sufficiently so that the casting can drop free of the mold upon release of the vacuum.

Still another object is to provide a mold of the above class which includes control means to precisely limit the penetration of the mold into the molten metal according to predetermined calculations and which can be quickly and easily adjusted as required by different levels of the molten metal due to repeated withdrawals thereof by successive castings.

The foregoing objects and such further objects as may appear herein, or be hereinafter pointed out, together with the advantages of this invention will be more fully discussed and developed in the more detailed description of the accompanying drawings.

DESCRIPTION OF THE PREFERRED EMBODIMENTS

Figure 1:
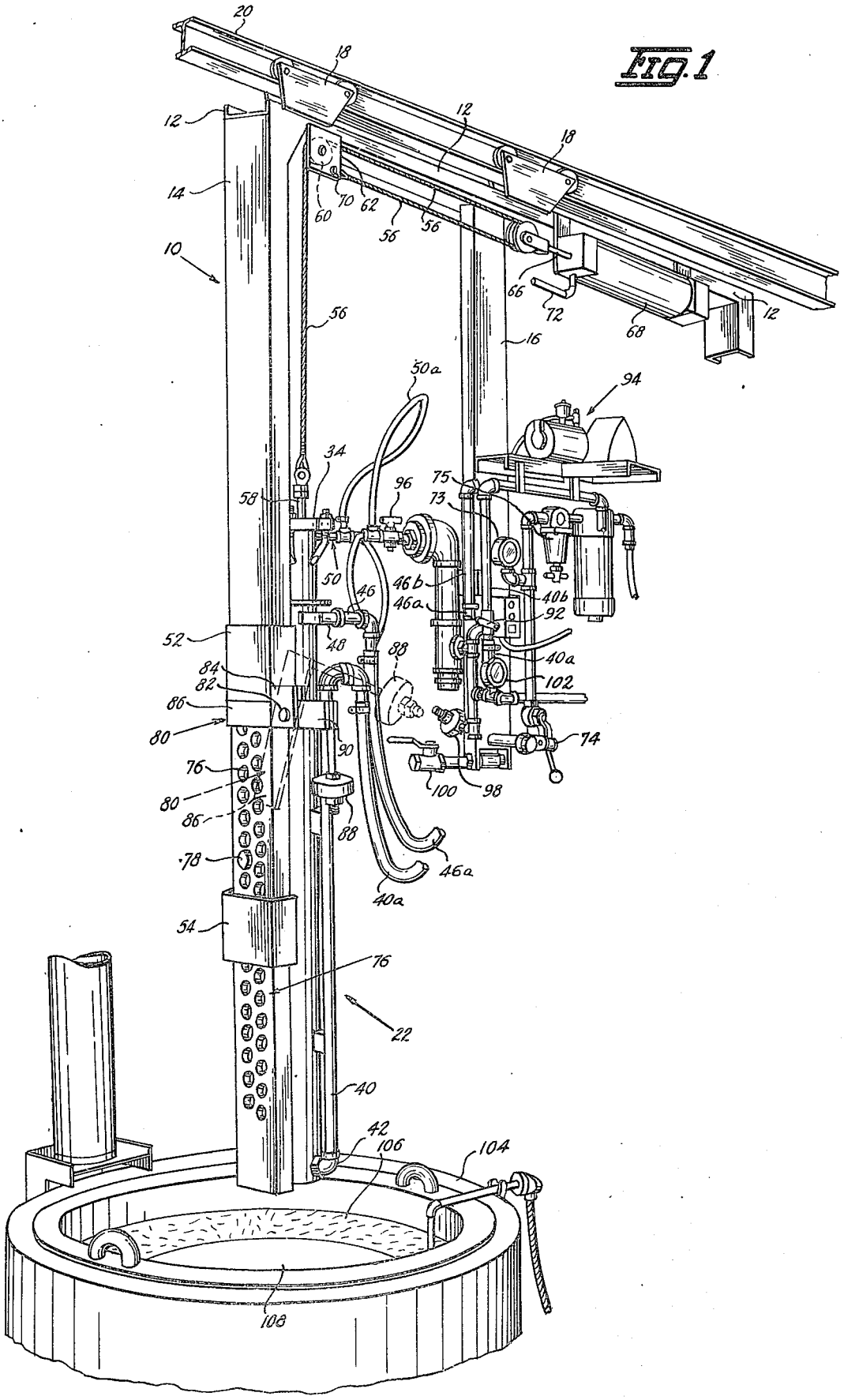
FIG. 1 is a perspective view of this new mold shown with a supporting carriage and in position above a pot of molten metal.

Referring to the drawings, a manually movable rigid support carriage, preferably of steel or the like, is designated generally by the numeral 10 and includes a horizontal top beam 12 to one end of which there is securely attached a depending elongated post 14 which is preferably rectangular in cross section. A second like shaped post 16, shorter than post 14, is also secured to and depends from beam 12 intermediate post 14 and the other end of said beam in parallel spaced relationship to post 14. Carriage 10 is designed to be laterally movable relative to an overhead support and for this purpose a pair of spaced trollies 18 attached to beam 12 are operable relative to a suitably supported I-beam track 20 in a well known manner. Thus far described, the long post 14 carries my new mold 22 which is associated with sources of water and vacuum and various controls therefor that are carried by post 16 as will appear in more detail as this description proceeds.

Figure 2:
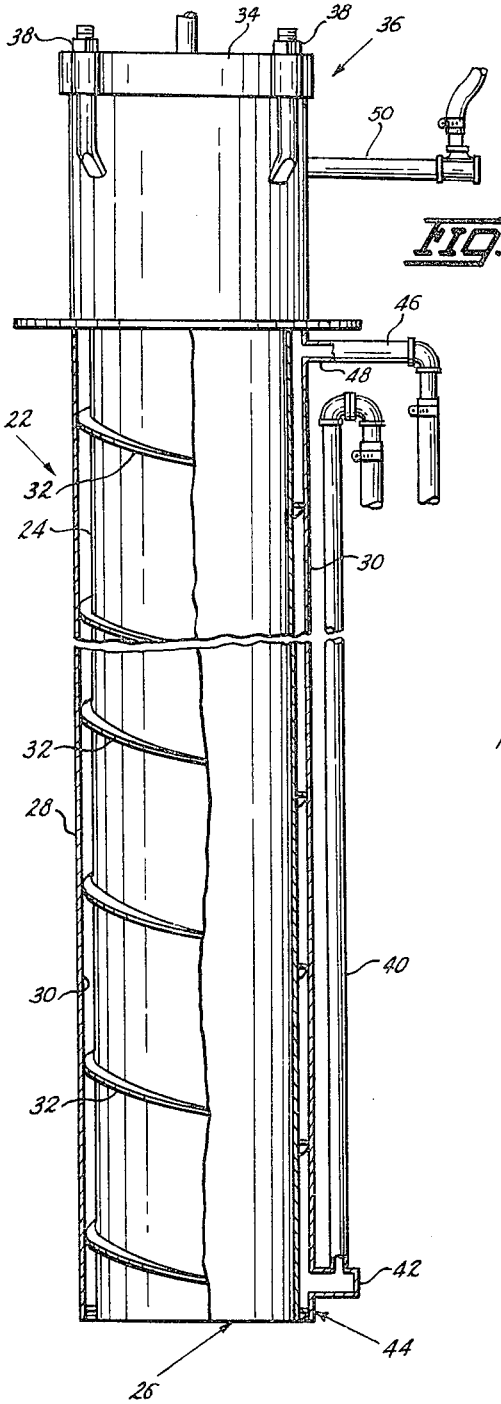
FIG. 2 is an enlarged view, partly in section, of the water cooled mold used in this invention, and FIGS. 3–6 inclusive are respective schematic views showing the successive positions of the mold relative to a pot of molten metal during the casting method of this invention.

With reference now more particularly to FIG. 2, I show my new water cooled mold 22 which is depicted in cylindrical form for purposes of illustration but which may be of any desired cross sectional shape in accordance with the determined shape of the billet or casting to be produced. Mold 22 defines an elongated hollow body 24 open at the bottom 26 and encased in an outer housing or jacket 28 arranged in spaced relationship thereto, preferably on the order of one to two eights of an inch, to provide a water chamber 30. A spiral rib or bead 32 is provided on the external surface of body 24 so as to be disposed in chamber 30 and a cap 34 is removably attached to the top 36 of mold 22 by the bolt means 38. A water inlet pipe 40 connects to the bottom of chamber 30 through a stub inlet pipe 42 spaced upwardly from bottom 26 to provide adequate freeboard area 44 below the bottom of chamber 30 when mold 22 is used as will appear. Preferably, the freeboard 44 depth is at least one quarter inch and may be greater if desired. A water outlet pipe 46 connects to the upper end of chamber 30 at port 48 therein and an air line 50 is connected to mold 22 just below cap 34 for communication with the interior of body 24.

Mold 22 as described and as best seen in FIG. 1, is mounted in juxtaposition to the long post 14 for vertical movement relative thereto by means of vertically spaced keepers 52 and 54 secured thereto and slidably journalled on post 14 as shown. In this regard, it is pointed out that elongated molds of different selected cross sections but including the water chamber 30, inlet and outlet water lines 40, 46, air line 50 and keepers 52 and 54 can be separately fabricated and interchangeably mounted on post 14 for use as hereinafter described relatively to mold 22.

The operation of mold 22, as will later appear, utilizes conventional sources of supply for water under pressure, air pressure and vacuum producing means for which no invention is claimed per se and thus such facilities are not shown in full detail although sufficient of the same and the controls related thereto for purposes of this description are shown in FIG. 1 where they are generally mounted for convenience on post 16.

The raising and lowering of mold 22 relative to post 14 is accomplished by air pressure although it is not intended to be limited thereto as any effective means such as hoists and the like may be employed in a well known manner. As seen in FIG. 1, a cable 56 is secured to an anchor bolt 58 on cap 34 so as to extend upwardly parallel to post 14 where it is reeved over a pulley 60 secured to a plate 62 suspended from beam 12. From pulley 60, cable 56 extends parallel to beam 12 in the direction of post 16 where it is reeved over a second pulley 64 suitably affixed to a projecting plunger shaft 66 forming a part of an air cylinder 68 which is suspended from beam 12. From pulley 64, cable 56 returns to plate 62 where it is anchored as at 70. An air line 72 from air cylinder 68 includes the air gauge 73 and is operatively connected to and controlled by the air valve 74 and, in the operation of air cylinder 68, the movement of pulley 64 toward and away from pulley 60 effects the lowering and raising of mold 22 relative to post 14 as will be apparent. Air pressure to the air cylinder 68 is adjustable by the diaphragm valve 75.

For limiting the downward movement of mold 22 to precisely determined stop points, the lower portion of post 14 is provided with two parallel rows of vertically spaced holes 76 with the spacing between the axes in respective rows being at a predetermined distance and the axes in the respective rows being offset to each other whereby the overall arrangement of holes 76 provides half distance measurements between the fixed hole spacing in each row. A removable stop pin 78 is insertible into any selected hole in rows 76 so as to project slightly beyond the fact of post 14 as seen in FIG. 1. Thus arranged, the upper keeper 52 has sufficient clearance relative to the face of post 14 from which pin 78 projects so that by itself, it will move freely pass such pin. However, an elongated stop bar 80 is pivotally secured intermediate its length as at 82 to a support plate 84 attached to keeper 52 so that a portion 86 of bar 80 can abut the underside of keeper 52 in sufficiently close relationship to post 14 so as to engage pin 78 in limiting the downward movement of mold 22. This engaging position is normally maintained by the weighted handle 88 attached to the end portion 90 of bar 80. Bar 80 is manually movable on pivot 82 to a nonengaging position with pin 78 as seen in the broken line position in FIG. 1 which will later be referred to in more detail.

The water inlet pipe 40 is connected by a flexible hose 40a to an inlet pipe 40b on post 16, it being understood that pipe 40b is connected to a source of water under pressure (not shown) and for which the valve control 92 is provided. The outlet pipe 46 is connected by a flexible hose 46a to the outlet pipe 46b mounted on post 16 and the air line 50 is connected by a flexible hose 50a to a source of vacuum designated generally by the numeral 94 for which there is provided the vacuum shut off valve 96 for use when the vacuum is to be reset in relation to the length of the billet to be cast. Adequate lengths of the flexible hoses described should be provided to permit of the raising and lowering of mold 22 as will appear. Also associated with the vacuum system for mold 22 in a well known manner are the vacuum regulating diaphragm valve 98, the vacuum release valve 100 and the vacuum gauge 102 and thus constructed and arranged, this mold is used in the following manner.

OPERATION

The carriage assembly 10 is arranged so that in its travel on track 20, post 14 with the associated mold 22 can be brought into registration over a pot 104 containing a supply of molten metal 106 and it will be noted that the bottom of post 14 terminates at a level slightly above the top level of pot 104. No invention is claimed for the pot structure and it will be understood that any suitable pot or container with means for producing molten metal may be used as are well known.

Carriage assembly 10 is easily manually movable by an operator pushing or pulling on post 16 and the successive positions of mold 22 to be described are shown in the schematic views in FIGS. 3–6 inclusive.

Figure 3:
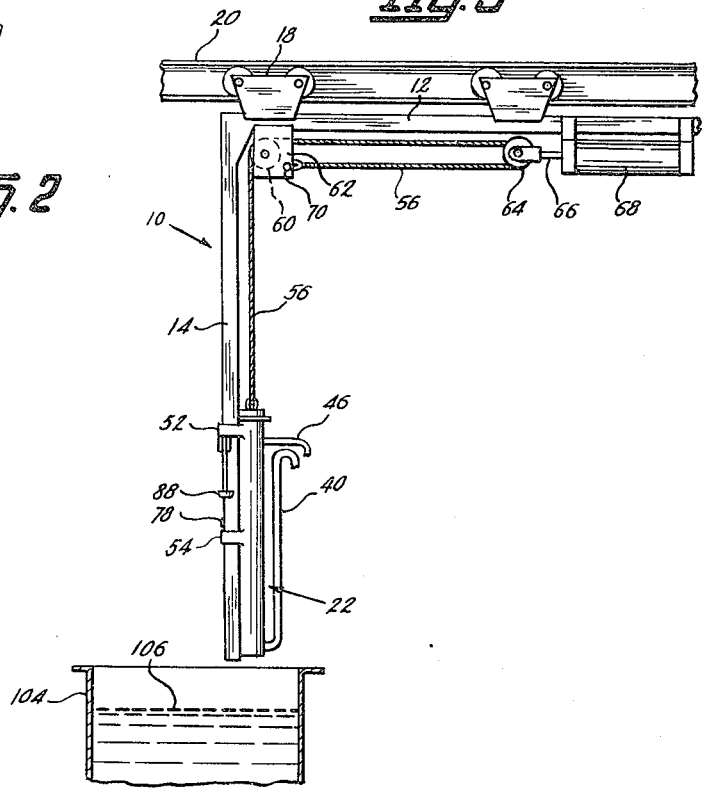

Assuming that the metal 106 is ready for casting, mold 22 is moved to the position shown in FIG. 3 in position over the pot 104 ready to be lowered to the proper depth, it being understood that mold 22 is being held in its elevated position by operation of the air cylinder 68. The proper depth to which mold will be lowered into the metal 106 is that point at which the molten metal covers the freeboard 44 (FIG. 4) so as to prevent air from entering the mold 22 through bottom 26 but is below the water level in chamber 30 at the inlet 42. This level is determined prior to lowering the mold 22 according to the level of metal 106 in the pot 104 whereby pin 78 is inserted into an appropriate hole in one of the rows 76. With pin 78 in place, the oxides on the surface of the metal 106 are removed by a paddle or the like (not shown) to form a clear area 108 below mold 22 (FIG. 1) and the mold 22 is then lowered by operation of air cylinder 68 by manipulation of valve 74 to the position shown in FIG. 4 where portion 86 of stop bar 80 has abutted pin 78 to limit the downwardly travel to the predetermined position of the mold 22.

Figure 4:
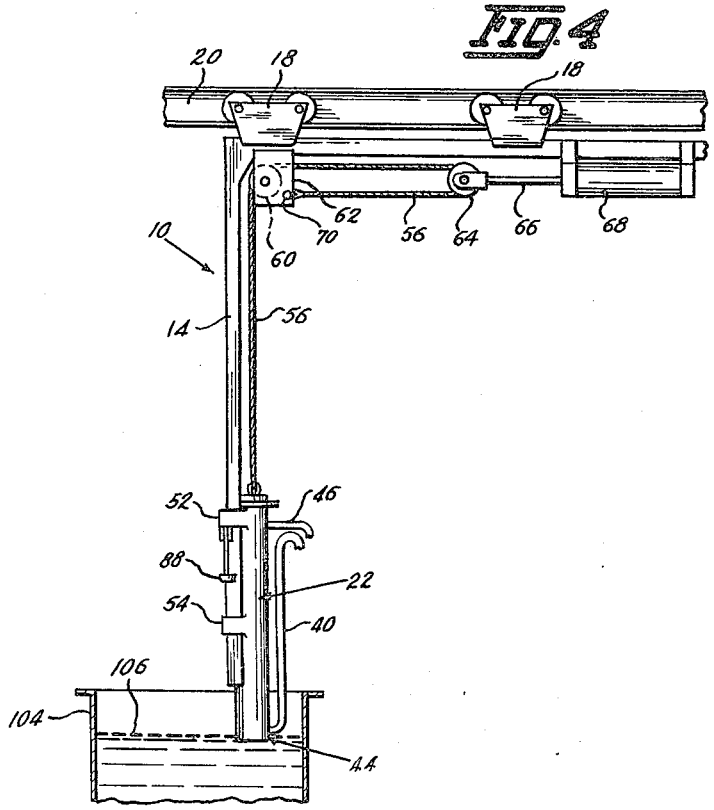

In the FIG. 4 position of mold 22, the vacuum release valve 100 is closed to induce a vacuum on mold 22 and pull a column of molten metal 106 up into the mold. The length of the column drawn into the mold may be varied by regulation of the vacuum and this is determined by appropriate setting of the vacuum regulating diaphragm valve 98. When the desired vacuum has been reached as will be indicated on gauge 102, the water valve 92 is turned on to circulate water through chamber 30. In this regard, an important feature of this mold and process associated therewith is the fact that the water moves rapidly through chamber 30, which is facilitated by the spiral ribe 32, to effect a high heat transfer and rapid cooling with the water pressure being high enough to prevent flash steam by providing a high velocity at the surface of the mold. If water is permitted to turn to steam, the cooling efficiency will be adversely affected and proper hardening of the column will not occur at the bottom of the mold. Further, in this regard, it will be appreciated that in setting pin 78 as described, the importance of keeping the level of metal below the water inlet 42 is to eliminate initial contact of the metal with any water surrounded mold portion which would cause hardening of the column at such point.

The length of time mold 22 is kept in the FIG. 4 position with the water cooling function in operation will vary according to the particular alloy being cast, the metal temperature and the overall size of the casting and thus some experimentation may be required for this purpose. In this regard, for example, I have found time intervals of fifty to ninety seconds required for various castings having a diameter of approximately two and three eights inches and a length of approximately forty to fifty two inches. Thus, after a determined proper time interval, mold 22 is raised by manipulation of air valve 74 from pot 104 from the position in FIG. 4 to that shown in FIG. 5 and at this point, the column or billet 110 (identified in FIG. 6 but still within the mold in FIG. 5) has hardened so that the mold 22 is ready to be moved away from pot 104 to a position approximately five or six inches above floor level 112 as seen in FIG. 6. The lowering of mold 22 from the position in FIG. 5 to the position in FIG. 6 requires movement of the stop bar 80 to its broken line position shown in FIG. 1 whereby keeper 52 will bypass pin 78 as the mold 22 is lowered and as such mold is later elevated for another casting, the top of portion 86 of stop bar 80 will ride against the underside of pin 78 as such bar pivots on point 82 and as the mold rises so that bar 80 clears pin 78, the weighted handle 88 will return bar 80 to its solid line position shown in FIG. 1.

Figure 5:
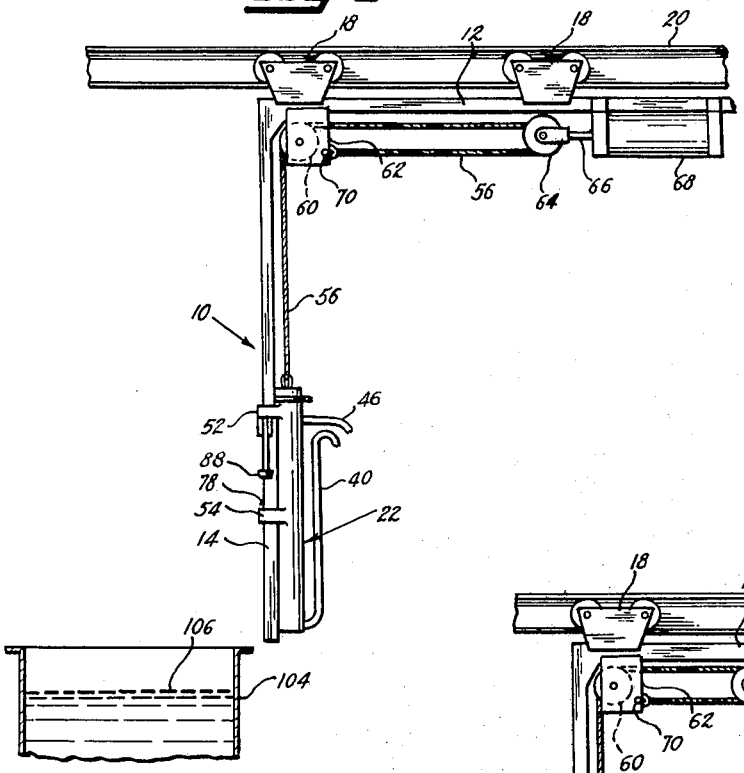
Figure 6:
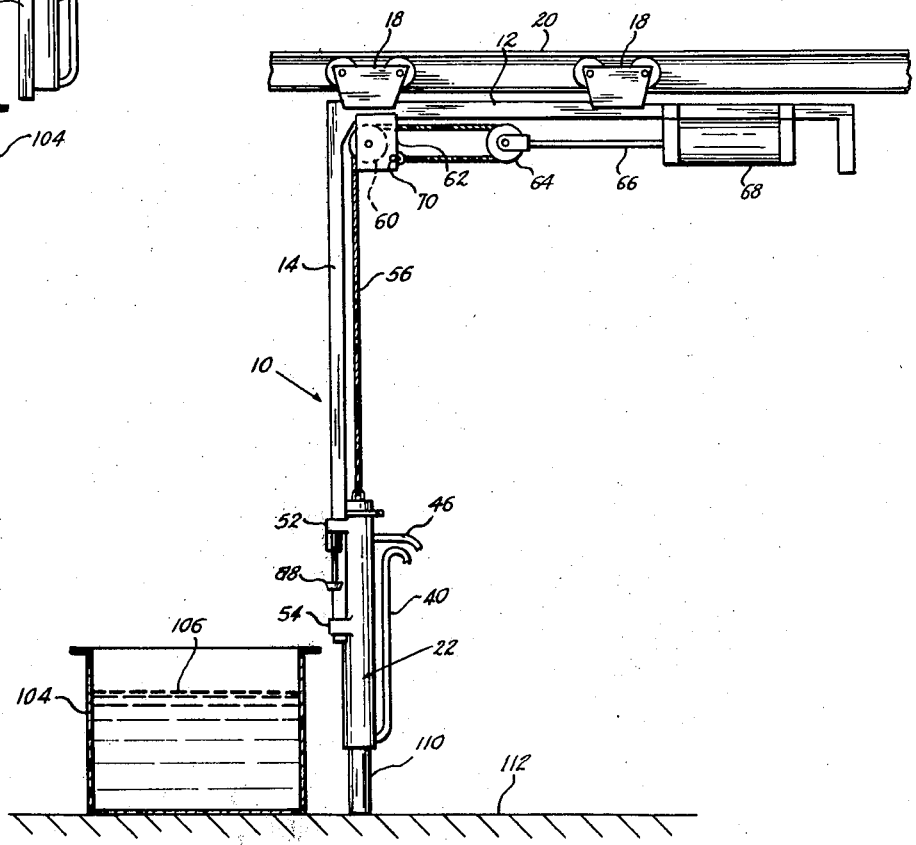

Intermediate the mold 22 positions as shown in FIGS. 5 and 6, the water valve 92 is closed to stop the cooling of the billet 110 and here again, the various considerations mentioned above for the time period of the FIG. 4 position will require some experimentation to avoid overcooling.

With mold 22 at the position shown in FIG. 6 and with the water valve 92 closed, the mold 22 will reheat sufficiently from contained heat in the billet 110 to expand relative to such billet so that by opening the vacuum release valve 100, billet 110 drops free as seen in FIG. 6 and is ready for use for processing into selected products. As the above process is repeated, the level of metal 106 in pot 104 will, of course, be lowered as metal is withdrawn so that properly adjusted settings for pin 78 must be accurately monitored.

Billets 110 cast according to the method herein described are completely free of air, have a very minor variable in the analysis of the cross sections thereof and have a surface that is completely smooth requiring no scarfing or other surface preparation. Such billets are of a uniform density and can be used for direct rolling in a rolling mill, processed through an extrusion press, for electrodes or in any way that a completely uniform, dense and blemish free billet is required. Accordingly, in view of the foregoing, it is thought a full understanding of the construction and operation of this invention will be had and the advantages of the same will be appreciated.

I claim:

1. A method of vacuum casting molten metal from a contained supply thereof, comprising the steps of:

lowering the open bottom end of a water jacketed mold into the molten metal, inducing a vacuum on the mold to draw a column of molten metal into the same, circulating water through the water jacket of the mold to effect rapid hardening of the column, removing the mold and allowing the contained heat in the hardened casting to reheat the mold and expand it relative to the casting from the supply of molten metal and then away from the container therefor, stopping the circulation of water to the mold, and releasing the vacuum on the mold to permit the casting to drop free by gravity.

2. A method as defined in claim 1 including positioning the mold approximately five to six inches above floor level after the mold is removed from the supply of molten metal.

3. A method as defined in claim 1 including limiting the penetration of the bottom end of the mold into the molten metal to a point where said bottom end is covered sufficiently to prevent the entrance of air and the metal level is below the lowermost extremity of the water jacket.

4. A method as defined in claim 1 including circulating the water through the water jacket under pressure with a high velocity at the surface of the mold to prevent flash steam and to effect a high heat transfer and rapid cooling of the casting.

5. A method as defined in claim 1 including circulating water through the water jacket of the mold from the bottom to the top thereof.

6. A method as defined in claim 1 including a selected degree of vacuum on the mold to draw a column of molten metal of a selected predetermined length into the mold.

* * * * *

UNITED STATES PATENT OFFICE

CERTIFICATE OF CORRECTION

Patent No. 3,996,992 Dated December 14, 1976

Inventor(s) Charles W. Johnson

It is certified that error appears in the above-identified patent and that said Letters Patent are hereby corrected as shown below:

Column 6, line 15, after "mold" delete "and allowing .... .....to the casting".

Column 6, line 20, after "mold" -- and allowing the contained heat in the hardened casting to reheat the mold and expand it relative to the casting -- should be inserted; and after "and" -- then -- should be inserted.

Signed and Sealed this

First Day of March 1977

[SEAL]

*Attest:*

RUTH C. MASON
*Attesting Officer*

C. MARSHALL DANN
*Commissioner of Patents and Trademarks*